US009765747B2

(12) United States Patent
Milliren

(10) Patent No.: US 9,765,747 B2
(45) Date of Patent: Sep. 19, 2017

(54) STARTER RETURN MECHANISM

(71) Applicant: Schaeffler Technologies GmbH & Co. KG, Herzogenaurach (DE)

(72) Inventor: Mark Milliren, Barberton, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 299 days.

(21) Appl. No.: 14/563,008

(22) Filed: Dec. 8, 2014

(65) Prior Publication Data

US 2015/0159616 A1 Jun. 11, 2015

Related U.S. Application Data

(60) Provisional application No. 61/914,598, filed on Dec. 11, 2013.

(51) Int. Cl.

| | |
|---|---|
| ***F02N 15/02*** | (2006.01) |
| *F02N 11/00* | (2006.01) |
| *F02N 11/08* | (2006.01) |

(52) U.S. Cl.

CPC ..... *F02N 15/025* (2013.01); *F02N 15/02* (2013.01); *F02N 11/00* (2013.01); *F02N 11/0814* (2013.01); *Y10T 74/132* (2015.01)

(58) Field of Classification Search

CPC ..... F02N 15/025; F02N 15/02; F02N 11/00; F02N 11/0814

See application file for complete search history.

(56) References Cited

U.S. PATENT DOCUMENTS

| | | | | |
|---|---|---|---|---|
| 4,274,292 | A * | 6/1981 | Arnett, Jr. | F02N 7/08 123/179.31 |
| 5,163,335 | A * | 11/1992 | Isom | F02N 15/006 123/195 A |
| 8,776,974 | B2 | 7/2014 | George et al. | |
| 2004/0244755 | A1* | 12/2004 | Wians | F02N 15/02 123/179.26 |
| 2010/0024757 | A1* | 2/2010 | Kashiwabara | F02F 7/0068 123/179.25 |
| 2011/0101693 | A1* | 5/2011 | Goi | F02C 7/275 290/46 |
| 2012/0080003 | A1* | 4/2012 | Schultz | F02N 11/003 123/179.31 |

FOREIGN PATENT DOCUMENTS

| | | | |
|---|---|---|---|
| JP | 2006002573 | A * | 1/2006 |

* cited by examiner

*Primary Examiner* — David M Fenstermacher
(74) *Attorney, Agent, or Firm* — Kevin L. Parks

(57) ABSTRACT

A permanently engaged starter assembly includes a ring gear, a return gear, and a starter gear. The return gear is fixed to a shaft of a starter return mechanism. The starter gear is arranged for fixing to a shaft of a starter motor and arranged in a torque path between the ring gear and the return gear. In an example embodiment, the ring gear has a central axis and the return gear is radially outside of the starter gear when measured from the ring gear central axis. In an example embodiment, the ring gear includes a first gear tooth, the return gear includes a second gear tooth, and the starter gear includes third and fourth gear teeth engaged with the first and second gear teeth, respectively.

18 Claims, 5 Drawing Sheets

STARTER RETURN MECHANISM

FIELD

The invention relates generally to a permanently engaged starter for a vehicle, and more specifically to a starter return mechanism.

BACKGROUND

Permanently engaged starters are known. One example is shown in commonly-assigned United States Patent Publication No. 2013/0098729 to George et al. for VEHICLE STARTING DEVICE, hereby incorporated by reference as if set forth fully herein.

BRIEF SUMMARY

Example aspects broadly comprise a permanently engaged starter assembly including a ring gear, a return gear, and a starter gear. The return gear is fixed to a shaft of a starter return mechanism. The starter gear is arranged for fixing to a shaft of a starter motor and arranged in a torque path between the ring gear and the return gear. In an example embodiment, the ring gear has a central axis and the return gear is radially outside of the starter gear when measured from the ring gear central axis. In an example embodiment, the ring gear includes a first gear tooth, the return gear includes a second gear tooth, and the starter gear includes third and fourth gear teeth engaged with the first and second gear teeth, respectively.

In an example embodiment, the shaft of the starter return mechanism extends predominantly from the return gear in a first axial direction and the shaft of the starter motor extends predominantly from the starter gear in a second axial direction, opposite the first axial direction. In some example embodiments, the permanently engaged starter assembly includes a starter housing for fixing the starter motor and the starter return mechanism to an engine. In an example embodiment, the shaft of the starter return mechanism includes a portion supported by the starter housing.

In some example embodiments, the return mechanism includes a slip tube and a torsion spring rotationally engaged with the starter return mechanism shaft and the slip tube. In an example embodiment, the torsion spring is disposed radially between the starter return mechanism shaft and the slip tube. In an example embodiment, each of the slip tube and the starter return mechanism shaft include respective helical cuts for rotationally engaging respective end coils of the torsion spring. In some example embodiments, the permanently engaged starter assembly includes a shaft plate fixed to the starter return mechanism shaft. The shaft plate has a radial tab arranged for lash engagement with a radial tab of the slip tube. In an example embodiment, the radial tabs are arranged to maintain preload of the torsion spring and limit rotational displacement of the starter return mechanism shaft relative to the slip tube.

In some example embodiments, the return mechanism has a housing, a first friction plate, and a resilient element. The first friction plate is drivingly engaged with one of the housing or the slip tube. The resilient element is for preloading the first friction plate for frictional engagement with the other of the housing or the slip tube. In an example embodiment, the resilient element is a wave spring, belleville washer, or diaphragm spring. In some example embodiments, the return mechanism further comprises a first clutch plate drivingly engaged with the other of the housing or the slip tube and contacting the friction plate. In an example embodiment, the return mechanism includes a second friction plate and a second clutch plate.

Other example aspects broadly comprise a return mechanism for a permanently engaged starter including a shaft, a slip tube, a torsion spring, and a shaft plate. The shaft includes a first helical cut. The slip tube includes a second helical cut and a first radial tab. The torsion spring is disposed radially between the shaft and the slip tube and includes respective end coils rotationally engaged with the first and second helical cuts. The shaft plate is fixed to the shaft and includes a second radial tab. The first and second radial tabs are arranged to maintain preload of the torsion spring and limit rotational displacement of the shaft relative to the slip tube.

In some example embodiments, the return mechanism includes a housing, a first friction plate, and a resilient element. The first friction plate is drivingly engaged with one of the housing or the slip tube. The resilient element is for preloading the first friction plate for frictional engagement with the other of the housing or the slip tube. In some example embodiments, the return mechanism further comprises a first clutch plate drivingly engaged with the other of the housing or the slip tube and frictionally engaged with the friction plate. In an example embodiment, the return mechanism further comprises a second friction plate and a second clutch plate.

BRIEF DESCRIPTION OF THE DRAWINGS

The nature and mode of operation of the present invention will now be more fully described in the following detailed description taken with the accompanying drawing figures, in which.

DETAILED DESCRIPTION

At the outset, it should be appreciated that like drawing numbers appearing in different drawing views identify identical, or functionally similar, structural elements. Furthermore, it is understood that this invention is not limited only to the particular embodiments, methodology, materials and modifications described herein, and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the following example methods, devices, and materials are now described.

Figure 1:
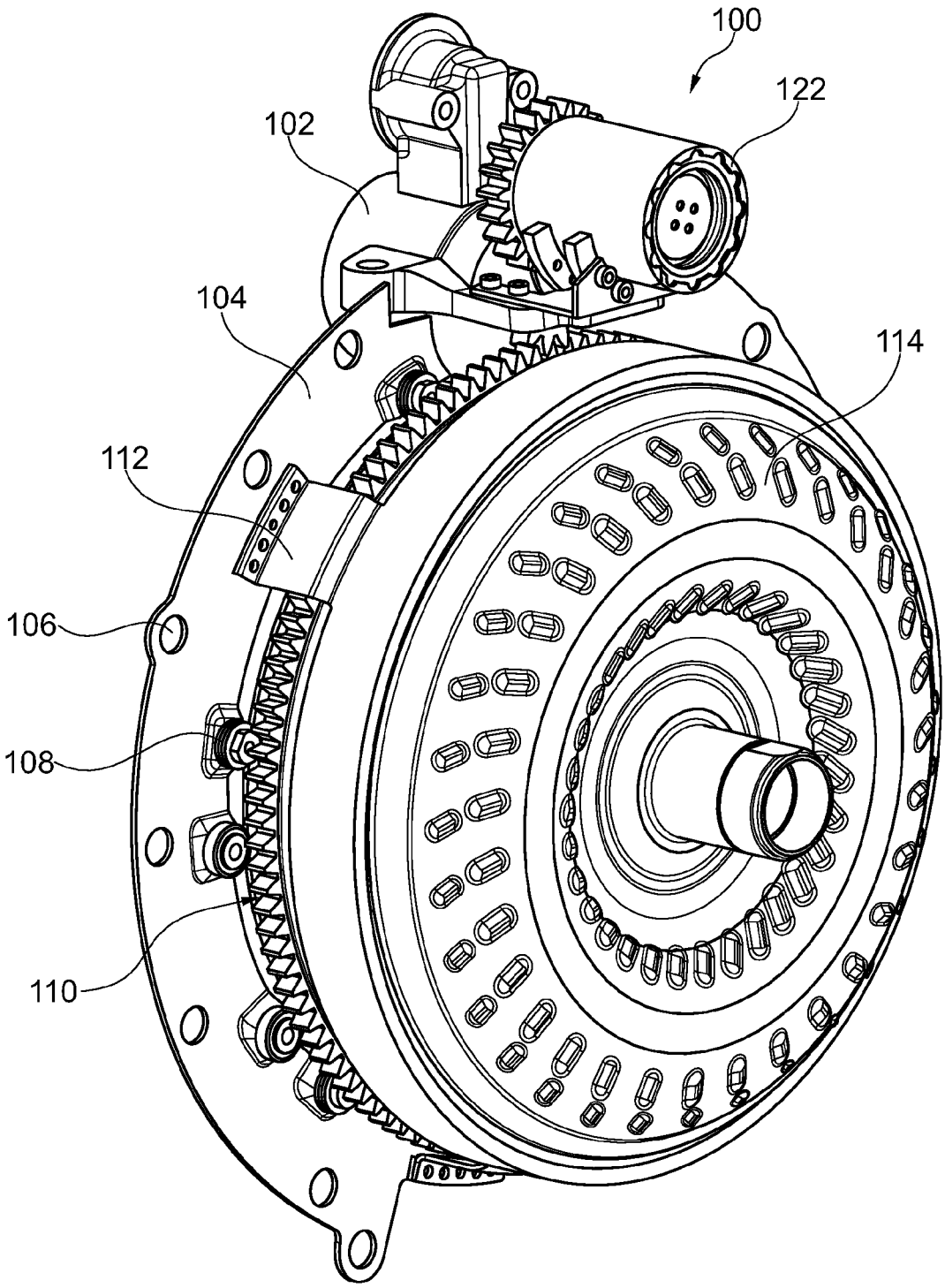
FIG. 1 is a perspective view of a permanently engaged starter assembly according to an example aspect.
Figure 2:
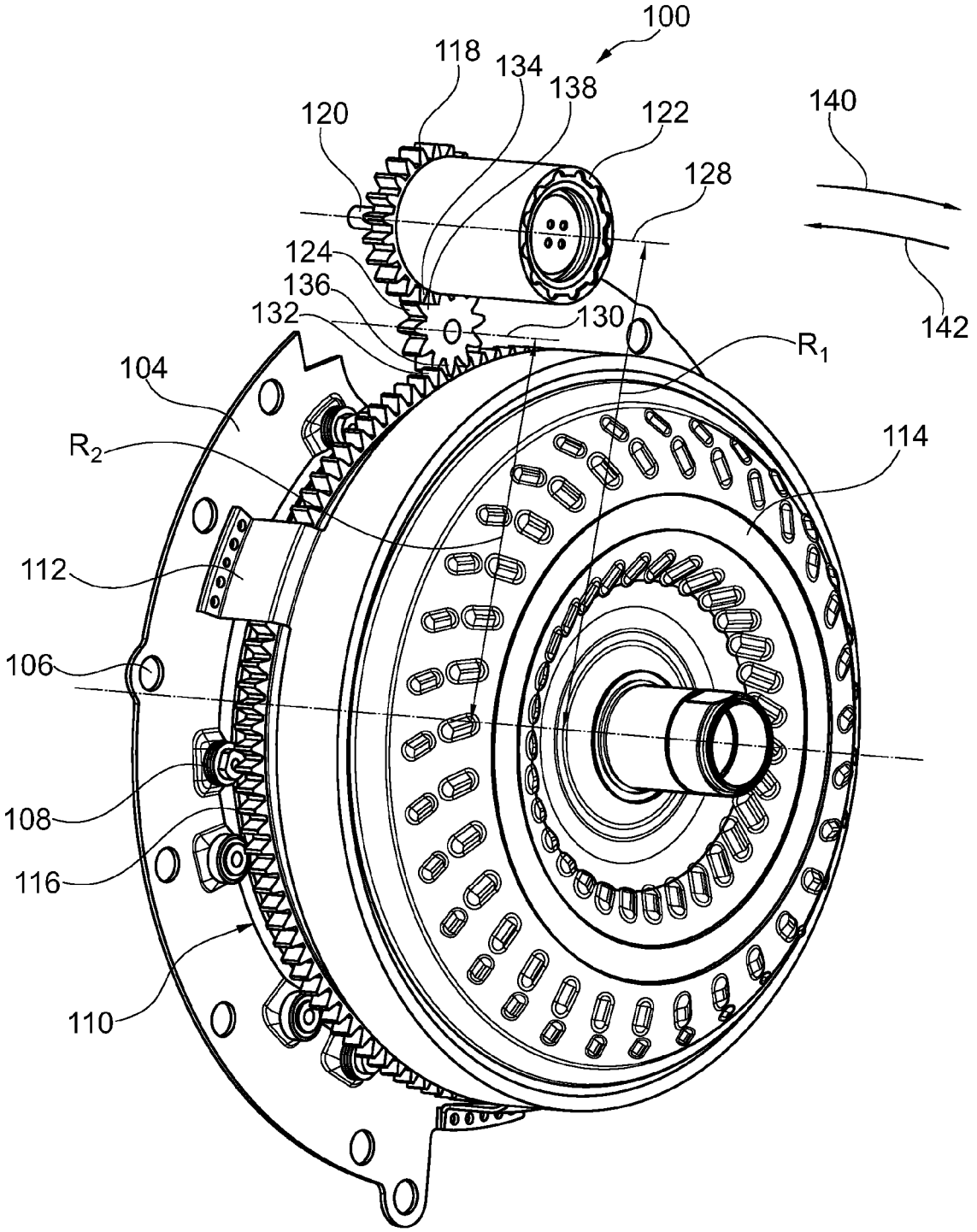
FIG. 2 is a perspective view of the permanently engaged starter assembly of FIG. 1 with a starter housing removed for clarity.

The following description is made with reference to FIGS. 1-2. FIG. 1 is a perspective view of permanently engaged starter assembly 100. FIG. 2 is a perspective view of permanently engaged starter assembly 100 of FIG. 1 with starter housing 102 removed for clarity. Assembly 100 is a portion of a starting system for a stop-start vehicle, for example. One such system is described in commonly-assigned United States Patent Publication No. 2013/0098729 to George et al. for VEHICLE STARTING DEVICE, hereby incorporated by reference as if set forth fully herein. Assembly 100 includes mounting plate 104 for installation between an engine (not shown) and a vehicle transmission (not shown) by fasteners installed in apertures 106, for example. Plate 104 includes rollers 108 for positioning a portion of ring gear assembly 110 and housing 112, fixed to plate 104, for retaining a wrap spring (not shown) arranged to engage an outer circumference of torque converter 114 to start the vehicle.

Permanently engaged starter assembly 100 includes ring gear 116, return gear 118 rotationally fixed to shaft 120 of starter return mechanism 122 by a key and keyway, for example, and starter gear 124 arranged for fixing to a shaft of a starter motor (not shown) installed in housing 102. Gear 124 is arranged in a torque path between ring gear 116 and return gear 118. That is, torque from the return gear passes through the starter gear to get to the ring gear, and vice versa. In other words, gears 116 and 118 are linked to one another by starter gear 124.

Ring gear 116 includes central axis 126 and return gear 118 is radially outside of starter gear 124 when measured from axis 126. That is, radial distance R1 measured from axis 126 to axis 128 of return gear 118 is greater than radial distance R2 measured from axis 126 to axis 130 of starter gear 124. Ring gear 116 includes gear tooth 132 and return gear 118 includes gear tooth 134. Starter gear 124 includes gear tooth 136 engaged with gear tooth 132 and gear tooth 138 engaged with gear tooth 134. That is, the starter gear is separately engaged with both the return gear and the ring gear, but the return gear and the ring gear are not engaged with one another.

Shaft 120 of the starter return mechanism extends from return gear 118 predominantly in axial direction 140 and the shaft (not shown) of the starter motor (not shown) extends predominantly from starter gear 124 in axial direction 142, opposite axial direction 140. By predominantly I mean that, although the shaft may extend from the gear in both directions (i.e., is passes through the gear), the shaft extends farther to one axial side of the gear than the other, and, in this embodiment, the farther extending sides of the return mechanism shaft and the starter shaft extend in opposite axial directions.

Assembly 100 includes starter housing 102. Housing 102 is for fixing the starter motor (not shown) and starter return mechanism 122 to an engine (not shown). That is, the starter housing is arranged for fixing to an engine in a manner known to one skilled in the art. Mechanism 122 is arranged for fixing to the starter housing, advantageously incorporating a starter return mechanism while maintaining a known starter assembly method. Shaft 120 of the starter return mechanism includes a portion supported by starter housing 102. That is, a distal end of shaft 120 extending from gear 118 in axial direction 142 extends into the starter housing and is supported by a bearing or bushing or the like.

Figure 3:
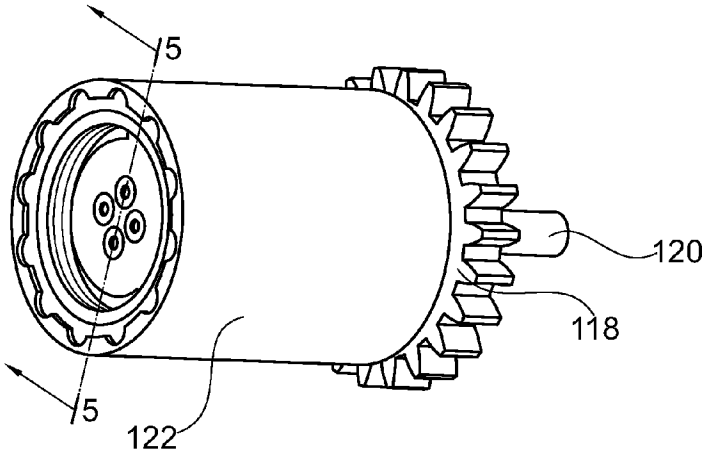
FIG. 3 is a perspective view of a starter return mechanism according to an example aspect.
Figure 4:
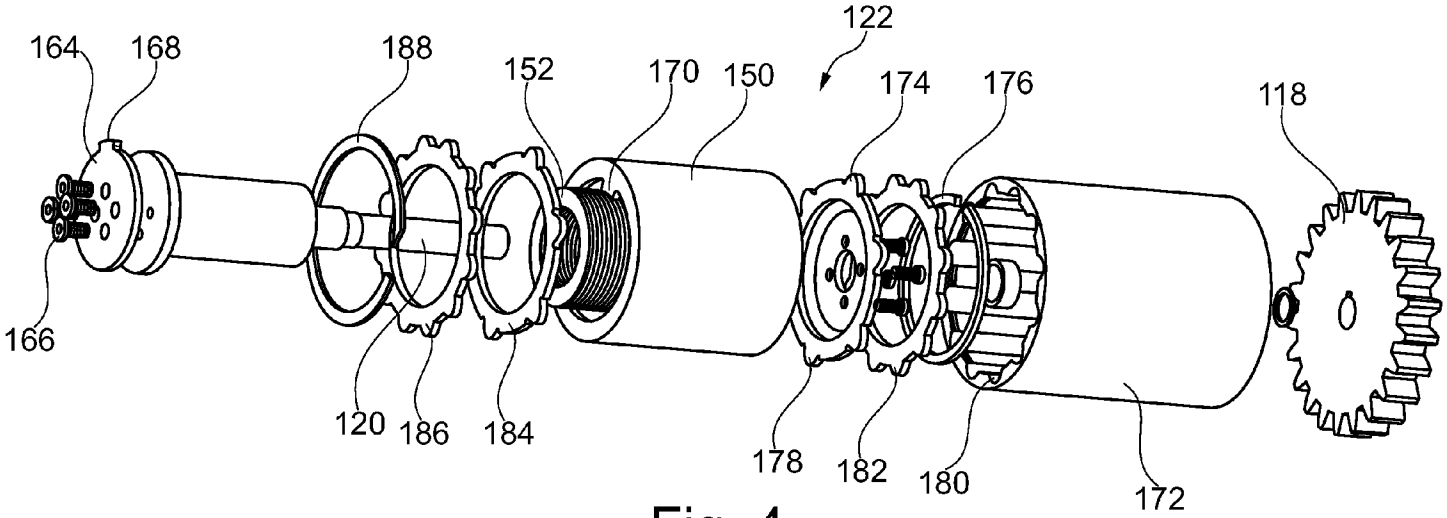
FIG. 4 is an exploded perspective view of the starter return mechanism of FIG. 3.
Figure 5:
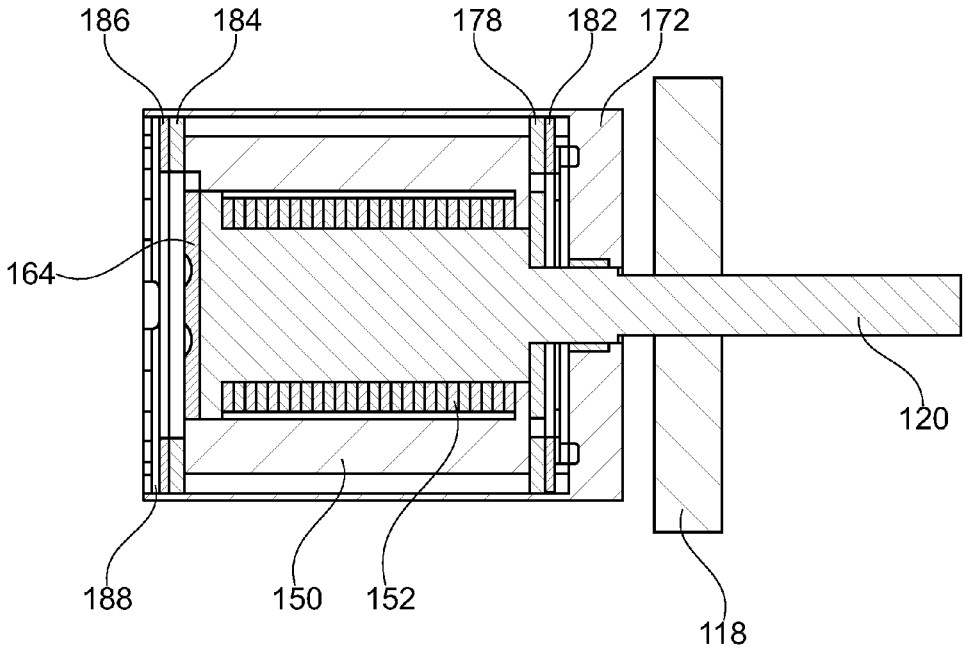
FIG. 5 is a cross-section view of the starter return mechanism of FIG. 3 taken generally along line 5-5 in FIG. 3.
Figure 6:
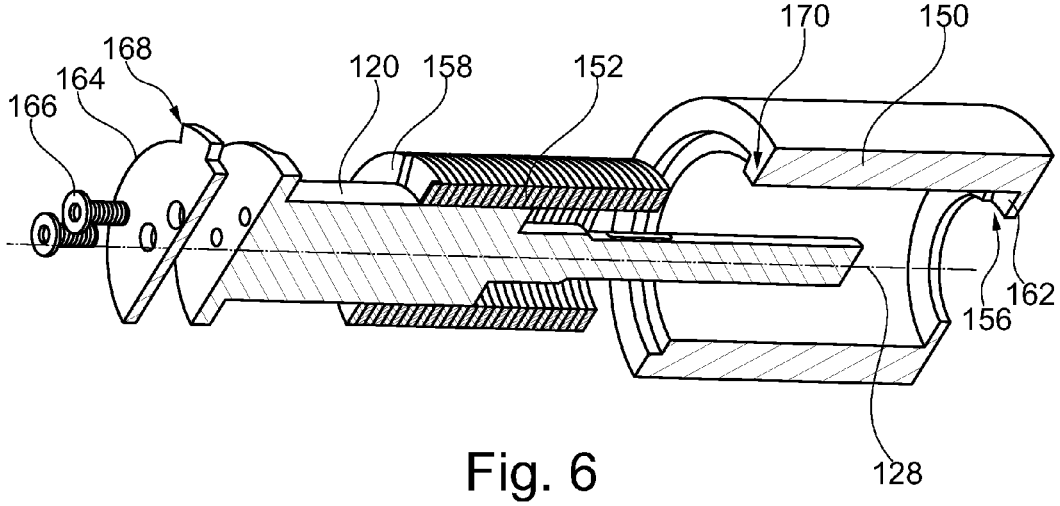
FIG. 6 is an exploded perspective view of a portion of the starter return mechanism of FIG. 3; and, FIG. 7 is a perspective view of a shaft for the starter return mechanism of FIG. 3.
Figure 7:
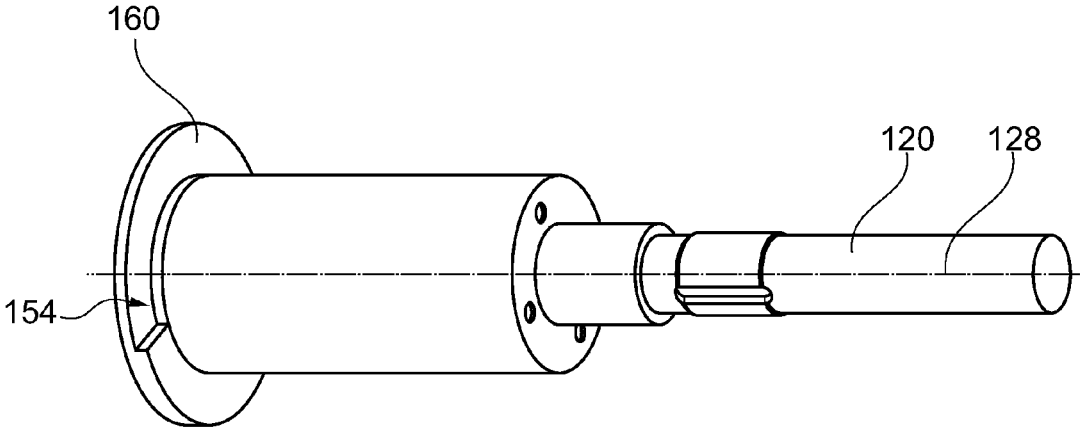

The following description is made with reference to FIGS. 3-7. FIG. 3 is a perspective view of a starter return mechanism 122 according to an example aspect. FIG. 4 is an exploded perspective view of the starter return mechanism of FIG. 3. FIG. 5 is a cross-section view of the starter return mechanism of FIG. 3 taken generally along line 5-5 in FIG. 3. FIG. 6 is an exploded perspective view of a portion of the starter return mechanism of FIG. 3. FIG. 7 is a perspective view of a shaft for the starter return mechanism of FIG. 3. Return mechanism 122 includes slip tube 150 and torsion spring 152. Torsion spring 152 may be a flat steel strip formed into a coil. Spring 152 is rotationally engaged with starter return mechanism shaft 120 and slip tube 150. As shown best in FIG. 5, torsion spring 152 is disposed radially between shaft 120 and slip tube 150.

Each of the slip tube and the starter return mechanism shaft include respective helical cuts (i.e., cut 154 of FIG. 7 and cut 156 in FIG. 6) for rotationally engaging respective end coils (i.e., cut 154 is engaged with end coil 158 in FIG. 6) of the torsion spring. By helical cut, I mean a cut which leaves a circumferentially extending surface with a varying axial extent such that beginning and ending edges of the surface are separated by an axially extending surface, creating a ledge, or side face, for receiving an end coil of the torsion spring. By engaged with, I mean that each of the end coil and the cut includes a side face in contact with one another when the torsion spring is installed with the shaft and/or slip tube. Although both faces are shown aligned with a plane passing through axis 128 of shaft 120, other configurations of the faces are possible. For example, the faces may be aligned with a plane positioned at an acute angle with respect to the axis so that the torsion spring end coils are pulled tightly against an end surface (i.e., surface 160 of shaft 120 and/or surface 162 of tube 150) under load to prevent dislodging of the end coils.

Shaft plate 164 is fixed to shaft 120 by bolts 166, for example. Although shaft plate is shown as a separate component, other embodiments may include plate 164 integral with shaft 120. Plate 164 includes radial tab 168 for lash engagement with radial tab 170 of the slip tube. By lash engagement, I mean that tabs 168 and 170 are arranged to permit relative rotation between the shaft and slip tube, but prevent a full revolution of the shaft relative to the slip tube. That is, the shaft is rotatable relative to the slip tube from a first position in which a first tab face of the shaft plate is aligned with a first tab face of the slip tube, through a rotational angle less than three hundred sixty degrees to a second position in which a second tab face of the shaft plate, circumferentially offset from the shaft plate first tab face, is aligned with a second tab face of the slip tube, circumferentially offset from the slip tube first tab face. The radial tabs may be arranged to maintain preload of the torsion spring in the first position and limit rotational displacement of the starter return mechanism shaft relative to the slip tube in the second position. Together, the angle of rotation permitted by the tabs and the numbers of teeth on each of the return gear, starter gear, and ring gear determine the amount of unwrap of a wrap spring installed within housing 112. This unwrap is necessary to eliminate drag on the torque converter once the engine is started.

Return mechanism 122 includes housing 172, friction plate 174 and resilient element 176. Tabs 178 of friction plate 174 is drivingly engaged mating notches, or recesses, 180 in housing 172. Element 176 is for preloading friction plate 174 for frictional engagement with slip tube 150. That is, the resilient element presses the friction plate against the slip tube, generating a friction force when the two components are relatively rotated. Although the friction plate is shown engaged with the housing, other configurations of the friction plate are possible. For example, the friction plate may be drivingly engaged with slip tube 150 and frictionally engaged with the housing. Although resilient element 170 is shown as a wave spring, is could also be a belleville washer or diaphragm spring, for example.

Mechanism 122 includes clutch plate 182. Plate 182 includes tabs 184 drivingly engaged with notches 180 of housing 172. Clutch plate 182 contacts the friction plate to prevent axial displacement of the friction plate. Return mechanism 122 includes friction plate 184 and clutch plate 186 drivingly engaged with the housing in the same manner as friction plate 174 and clutch plate 182 described above. Snap ring 188 retains the friction plates, clutch plates, slip tube and resilient element within the housing. Friction torque on the slip tube is affected by a friction coefficient of the friction plates against the slip tube, a force exerted by the resilient element, and an axial location of a housing groove for snap ring 188.

Of course, changes and modifications to the above examples of the invention should be readily apparent to those having ordinary skill in the art, without departing from the spirit or scope of the invention as claimed. Although the invention is described by reference to specific preferred and/or example embodiments, it is clear that variations can be made without departing from the scope or spirit of the invention as claimed.

What I claim is:

1. A starter gear assembly comprising:
a ring gear;
a return mechanism comprising:
a slip tube;
a return mechanism shaft, and,
a torsion spring rotationally engaged with the return mechanism shaft and the slip tube:
a return gear fixed to the return mechanism shaft; and,
a starter gear arranged for fixing to a shaft of a starter motor and arranged in a torque path between the ring gear and the return gear.

2. The starter gear assembly of claim 1 wherein:
the ring gear has a central axis; and,
the return gear is radially outside of the starter gear when measured from the ring gear central axis.

3. The starter gear assembly of claim 1 wherein:
the ring gear includes a first gear tooth;
the return gear includes a second gear tooth; and,
the starter gear includes third and fourth gear teeth engaged with the first and second gear teeth, respectively.

4. The starter gear assembly of claim 1 wherein the starter return mechanism shaft extends predominantly from the return gear in a first axial direction and the shaft of the starter motor extends predominantly from the starter gear in a second axial direction, opposite the first axial direction.

5. The starter gear assembly of claim 1 further comprising:
a starter housing for fixing the starter motor and the return mechanism to an engine.

6. The starter gear assembly of claim 5 wherein the starter return mechanism shaft includes a portion supported by the starter housing.

7. The starter gear assembly of claim 1 wherein the torsion spring is disposed radially between the return mechanism shaft and the slip tube.

8. The starter gear assembly of claim 1 wherein each of the slip tube and the return mechanism shaft include respective helical cuts for rotationally engaging respective end coils of the torsion spring.

9. The starter gear assembly of claim 1 further comprising:
a shaft plate fixed to the return mechanism shaft and including a radial tab arranged for lash engagement with a slip tube radial tab.

10. The starter gear assembly of claim 9 wherein the radial tabs are arranged to maintain preload of the torsion spring and limit rotational displacement of the return mechanism shaft relative to the slip tube.

11. The starter gear assembly of claim 1 wherein the return mechanism further comprises:
a housing;
a first friction plate drivingly engaged with one of the housing or the slip tube; and
a resilient element for preloading the first friction plate for frictional engagement with the other of the housing or the slip tube.

12. The starter gear assembly of claim 11 wherein the resilient element is a wave spring, belleville washer, or diaphragm spring.

13. The starter gear assembly of claim 11 wherein the return mechanism further comprises a first clutch plate drivingly engaged with the other of the housing or the slip tube and contacting the friction plate.

14. The starter gear assembly of claim 13 wherein the return mechanism further comprises a second friction plate and a second clutch plate.

15. A return mechanism for a starter comprising:
a shaft including a first helical cut;
a slip tube including a second helical cut and a first radial tab;
a torsion spring disposed radially between the shaft and the slip tube and including respective end coils rotationally engaged with the first and second helical cuts; and,
a shaft plate fixed to the shaft and including a second radial tab, wherein the first and second radial tabs are arranged to maintain preload of the torsion spring and limit rotational displacement of the shaft relative to the slip tube.

16. The return mechanism of claim 15 further comprising:
a housing;
a first friction plate drivingly engaged with one of the housing or the slip tube; and
a resilient element for preloading the first friction plate for frictional engagement with the other of the housing or the slip tube.

17. The return mechanism of claim 16 wherein the return mechanism further comprises a first clutch plate drivingly engaged with the other of the housing or the slip tube and frictionally engaged with the friction plate.

18. The return mechanism of claim 17 wherein the return mechanism further comprises a second friction plate and a second clutch plate.

* * * * *